US005265665A

United States Patent [19]

Fujii et al.

[11] Patent Number: 5,265,665

[45] Date of Patent: Nov. 30, 1993

[54] CONTINUOUS CASTING METHOD OF STEEL SLAB

[75] Inventors: Tetsuya Fujii; Seiko Nara; Nagayasu Bessho; Hisao Yamasaki, all of Chiba, Japan

[73] Assignee: Kawasaki Steel Corporation, Japan

[21] Appl. No.: 892,154

[22] Filed: Jun. 2, 1992

[30] Foreign Application Priority Data

| | | | |
|---|---|---|---|
| Jun. 5, 1991 | [JP] | Japan | 3-134199 |
| Sep. 27, 1991 | [JP] | Japan | 3-249657 |
| Oct. 4, 1991 | [JP] | Japan | 3-257639 |
| Oct. 14, 1991 | [JP] | Japan | 3-264829 |

[51] Int. Cl.[5] ..... B22D 11/18; B22D 27/02

[52] U.S. Cl. ..... 164/466; 164/453; 164/488

[58] Field of Search ..... 164/502, 466, 504, 568, 164/488, 453

[56] References Cited

FOREIGN PATENT DOCUMENTS 62-130752 6/1987 Japan ..... 164/466

2-281750 11/1990 Japan ..... 164/466

*Primary Examiner*—Kuang Y. Lin

*Attorney, Agent, or Firm*—Austin R. Miller

[57] ABSTRACT

In a continuous casting of steel slab, a molten steel is provided having an oxygen concentration of not more than 35 ppm and is supplied from a tundish into a continuous casting mold through a straight immersion nozzle having an open end at the forward end thereof, the mold consisting of a combination of a pair of narrow face mold walls and a pair of wide face mold walls. A traveling magnetic field generating device is disposed on a central area of the outer surface of the wide face mold walls. While the open forward end of the nozzle is positioned in the magnetic field region of the traveling magnetic field generating device, a traveling magnetic field which is perpendicular to the wide face mold walls and which is traveling upward is applied to a flow of the molten steel discharged from the nozzle, thereby controlling the flow. Preferably, an upper or lower static magnetic field generating device or both of them may be also used.

6 Claims, 5 Drawing Sheets

"PRIOR ART"

"PRIOR ART"

CONTINUOUS CASTING METHOD OF STEEL SLAB

BACKGROUND OF THE INVENTION

1. Field of the Invention

The present invention generally relates to a method of continuous casting steel. Specifically, the present invention creates an important improvement in continuous casting in which magnetic poles are attached to the outer surface of a pair of opposing side walls of the mold and a straight immersion nozzle is employed, which art is adopted for continuous casting of a low C-Al killed steel. This is done with a view to assuring that, even when high-speed continuous casting is performed by, for example, increasing throughput per unit period of time, defects of products (such as sliver and blister) can be prevented from often occurring due to an increase in the amount of accumulatively trapped inclusions and/or an increase in the amount of included powders or bubbles.

2. Description of the Related Art

In general, measures for preventing such defects of products include the following:

(1) Purifying the molten steel to a higher degree by ladle refining (2) Employing a tundish of a greater capacity so as to prevent contamination by ladle slag and tundish powder, and (3) Improving the configuration of the immersion nozzle so as to prevent entrapping of various inclusions and powders into the mold However, these conventional measures can improve the purity of the molten steel used in a production process only to a limited extent when the process is adapted to meet various requirements such as the required levels of product quality and production quantity. Thus, these measures cannot be regarded as perfect measures.

In addition, once various inclusions and entrapped powders are brought into the mold, they cannot completely surface when the throughput per unit period of time is increased beyond a certain limit. In this case, therefore, these substances tend to be trapped in the steel.

A method has conventionally been proposed as a means of overcoming these problems. Electromagnets are disposed on the mold of a continuous slab casting machine, and a traveling magnetic field is applied to the molten steel in the mold in such a manner that the flow of the molten steel is controlled by the Lorentz force generated by the interaction of the current induced in the molten steel and the magnetic field. This makes it possible to prevent the flow of discharged molten steel from deeply penetrating the molten steel pool, thereby preventing the entrapping of mold powder and promoting surfacing of the various inclusions.

This conventional method is put to practice as indicated by the following examples:

(i) When a two-hole nozzle is used as the immersion nozzle, a traveling magnetic field is applied to a region corresponding to the full width of the wide face walls of the mold, and the magnetic field is caused to travel in the widthwise direction of the wide face walls of the mold (see page 356 of "Proceedings of the Sixth International Iron and Steel Congress (IISC), 1990")

(ii) When a two-hole nozzle is used as the immersion nozzle, a traveling magnetic field is applied to a region corresponding to part of the full width of the wide face walls of the mold, and the magnetic field is caused to travel in a vertical direction with respect to the direction of casting (see page 309 of "Proceedings of the Sixth IISC, 1990")

The first method (i) employs, as shown in FIG. 5, an immersion nozzle 2 comprising a two-hole nozzle having an ejection hole 2*a* on each side. Magnetic poles 5 for generating a traveling magnetic field are disposed in an area corresponding to the full width of the wide face walls (not shown) of the mold which are held between narrow face walls 1*a* of the same and including the position of the ejection holes 2*a* of the nozzle 2. A magnetic field generated by the magnetic poles 5 is reciprocated in a widthwise direction relative to the steel piece being cast, that is, in a horizontal direction, thereby accelerating or decelerating the flow of the molten steel ejected from the ejection holes 2*a* of the nozzle 2, so as to prevent inclusions 14 or bubbles 15 from entrapping with the molten steel 16 in the mold or to effect the compensation of the molten steel heat regarding the meniscus 7.

According to the FIG. 5 method, when the flow of discharged molten steel is decelerated by the traveling magnetic field, the magnetic field acts as a reflecting plate with respect to the molten steel flow. As a result, the molten steel flow is divided into an upwardly flowing stream 12 and a downwardly flowing stream 13. The upwardly flowing stream 12 causes mold powder to be entrapped at the meniscus 7, while the downwardly flowing stream 13 causes inclusions 14 and bubbles 15 to penetrate into the mold. There is a risk that these substances will be trapped by or in the solidified shell 6.

Conversely, when the flow of discharged molten steel is accelerated by the traveling magnetic field, although heat compensation at the meniscus 7 can be ensured, an increased amount of reversing current occurs on the narrow face walls 1*a*. This results in entrapping of mold powder and the penetration of inclusions and bubbles being promoted.

The second method (ii) also employs, as shown in FIG. 6, an immersion nozzle 2 comprising a two-hole nozzle having an ejection hole 2*a* on each side. In this case two magnetic poles 5 are provided for generating a traveling magnetic field. They are disposed in an area corresponding to a part of the full width of wide face walls (not shown) and comprise sections on either widthwise side of the position of the nozzle 2. The magnetic field generated by the two magnetic poles 5 is traveled in a downward direction with respect to the direction of casting, thereby decelerating that part of the flow of the molten steel ejected from ejection holes 2*a* of the nozzle 2 and heading toward narrow face walls 1*a* of the mold to collide therewith.

According to the FIG. 6 method, since the magnetic field is not applied in the full width of the wide face walls of the mold, the regions which are not acted upon by the magnetic field involve an upward stream 12 or a downward stream 13 of the molten steel, thereby failing to satisfactorily prevent the entrapping of mold powder at the meniscus 7 or the penetration of inclusions 14 and bubbles 15 into the molten steel in the mold.

The use of a two-hole nozzle as the immersion nozzle in the conventional methods (i) and (ii), as shown in FIGS. 5 and 6, respectively, has the following disadvantages: (a) one-sided flow may occur in the molten steel in the mold due to nozzle clogging; and (b) since argon (Ar) gas is introduced through an Ar gas supply port (as indicated by reference numeral 4 in FIG. 5), there is a risk of blisters on the cast steel and other surface defects occurring.

Inclusions and bubbles may be penetrated deeper into the molten steel in the mold when there is a one-sided flow in the mold due to an imbalance, caused by nozzle clogging, between the respective ejection areas of the two ejection holes of the immersion nozzle, or there is a change in casting speed, or the width of slab cast is changed.

The immersion nozzle for forming a flow passage between the tundish 3 containing the molten steel and the continuous casting mold 1, as shown in FIG. 5, is usually formed of a refractory material, in the continuous casting of steel. With such an immersion nozzle, alumina tends to adhere to the inner surface of the nozzle particularly during the continuous casting of an Al killed steel. As a result, the flow passage of the molten steel becomes increasingly narrower as time passes from the start of a casting operation, thereby making it impossible to attain a desired flow of molten steel.

Severe adhesion of alumina occurs at a location where the flow of the molten steel deflects and, accordingly, tends to stagnate. When a two-hole nozzle is used, such a location is the vicinity of the ejection holes of the nozzle.

In order to cope with the problem of the clogging of a two-hole immersion nozzle, the conventional practice has usually included, as previously described, the step of bubbling an inert gas such as argon, into the molten steel supplied through the nozzle. However, when the feed rate of the inert gas is great, some of the inert gas may not surface to the molten steel surface, and part may be trapped by the solidified shell 6 (such as that shown in FIG. 5) in the mold, thereby involving the risk of a defect of the final product. Further, nozzle clogging cannot be sufficiently prevented by merely supplying an inert gas into the nozzle, and it is necessary to replace the nozzle frequently. When the immersion nozzle is of the two-hole type, such as the immersion nozzle 2 (shown in FIGS. 5 and 6) having two ejection holes 2*a* at symmetrical positions on either side of the forward end of the nozzle, the immersion nozzle is vulnerable to asymmetrical clogging of the ejection holes, thereby involving problems such as reduction in the product quality.

One form of effort to overcome the above problems involves the use of a nozzle containing CaO capable of reacting with alumina to form a compound having a low melting point. However, the use of such a nozzle has not been able to achieve effective results. Among other efforts, Japanese Patent Laid-Open No. 60-92064 discloses a method of pouring a molten metal adapted to restrain nozzle clogging. In this method, a DC magnetic field is applied to the flow of a molten steel within the nozzle so as to transform the molten steel flow into a laminar flow. With this method, however, since the flow of the molten steel descends deep into the crater of the molten metal in the mold, there is a risk of the accompanying inclusions failing to surface and becoming trapped by a solidified shell.

On the other hand, it has not been possible to use a straight immersion nozzle having an open end provided at the forward end of the nozzle body to constitute a discharge hole for the molten steel. This is because the flow passage within the nozzle has no bend, and the flow of discharged molten steel heads vertically downwardly toward the exit of the mold. As a result the inclusions in the molten steel, gas bubbles, etc. penetrate deep into the crater, involving the risk of an internal defect of the sheet steel product. Further, since the solidified shell is washed by the high-temperature molten steel flow heading vertically downwardly, the washed portion of the shell is hindered from solidifying, involving the risk of breakouts being generated, which makes casting impossible.

SUMMARY OF THE INVENTION

An object of the present invention is to provide a method of continuously casting a steel slab which is capable of overcoming the above-described problems of continuous casting, and obtaining a slab steel that has good surface and internal qualities.

To achieve this object, according to the present invention, there is provided a method of continuously casting steel comprising: supplying a molten steel having an oxygen concentration of not more than 35 ppm from a tundish containing the molten steel into a continuous casting mold through a straight immersion nozzle having an open end at the forward end thereof, the mold consisting of a combination of a pair of narrow face mold walls and a pair of wide face mold walls; disposing a traveling magnetic field generating device on a central area of the outer surface of the wide face mold walls; and, while the open forward end of the nozzle is positioned in the magnetic field region of the traveling magnetic field generating device, applying a traveling magnetic field which is perpendicular to the wide face mold walls and which is traveling upward to a flow of the molten steel discharged from the nozzle, thereby controlling the flow.

In a preferred embodiment of the present invention, a method of continuously casting a steel slab further comprises: disposing static magnetic field generating devices on areas of the outer surface of the wide face mold walls which extend over the full width of the wide face mold walls and which are at a position above the traveling magnetic field generating device corresponding to the molten steel surface in the mold and a position below the traveling magnetic field generating device; and applying a static magnetic field perpendicular to the wide face mold walls to a full-width region in the vicinity of the traveling magnetic field, thereby stabilizing the molten steel surface, while applying a static magnetic field perpendicular to the wide face mold walls to a full-width region below the traveling magnetic field, thereby making uniform a downward stream of the molten steel.

DETAILED DESCRIPTION OF THE INVENTION

Figure 1A:
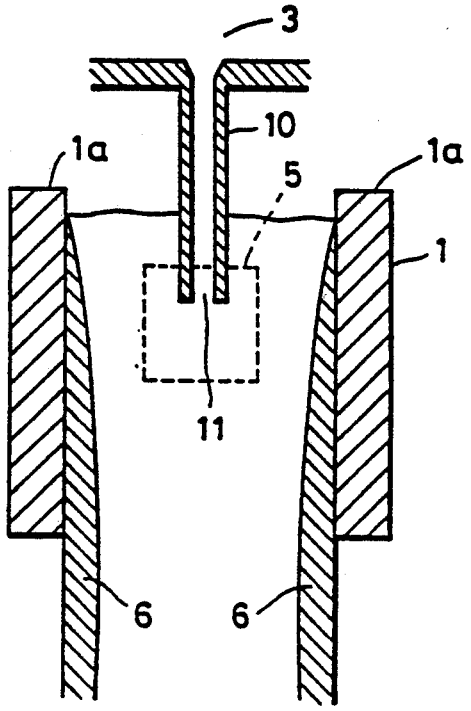
FIGS. 1(A) and 1(B) are sectional views showing the essential parts of a continuous casting apparatus which may be used to carry out a method according to the present invention, FIG. 1(A) being a front sectional view, and FIG. 1(B) being a side sectional view.
Figure 1B:
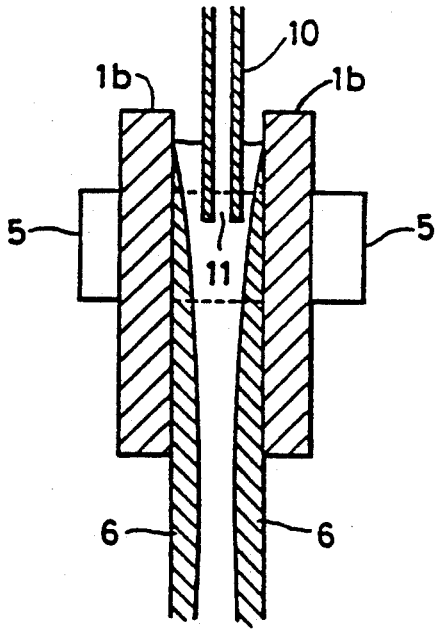

Referring to FIGS. 1(A) and 1(B), a continuous casting apparatus which may be suitably used to carry out a method according to the present invention includes a continuous casting mold 1. The mold 1 consists of a combination of a pair of narrow face walls 1*a* (shown in section in FIG. 1(A)) and a pair of wide face walls 1*b* (shown in section in FIG. 1(B)). A straight immersion nozzle 10 has a nozzle body which communicates with a tundish 3 (FIG. 1) and the forward end of which is open to constitute a straight discharge hole 11. A traveling magnetic field generating device 5 is disposed on the outer surfaces of the wide face walls 1*b* of the mold 1 for the purpose of applying, to a flow of a molten steel discharged from the straight immersion nozzle 10, a traveling magnetic field perpendicular to the wide face mold walls 1*b* and traveling upward.

Figure 2A:
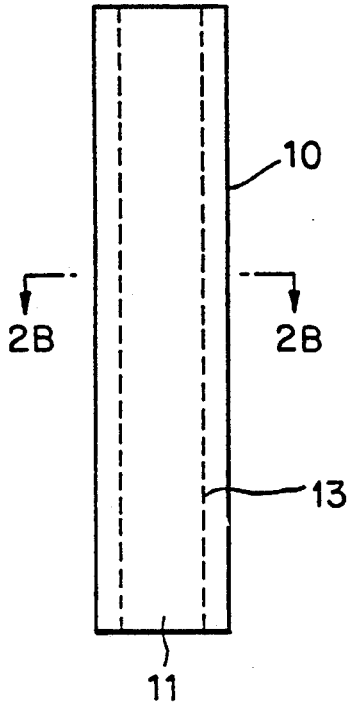
FIGS. 2(A) and 2(B) are views of a straight immersion nozzle used in the present invention, FIG. 2(A) being a side view, and FIG. 2(B) being a sectional view taken along the line A—A shown in FIG. 2(A)
Figure 2B:
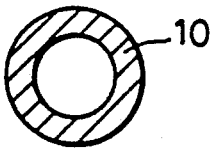

The straight immersion nozzle 10 having an inner surface 13 terminating at discharge hole 11 is shown in a side view and a cross-sectional view in FIGS. 2(A) and 2(B), respectively. One of the most important features of the present invention is that the straight immersion nozzle 10 having the straight discharge hole 11 defined by the opening at the forward end of the nozzle body, is used as an immersion nozzle.

According to the present invention, continuous casting is performed while, as shown in FIGS. 1(A) and 1(B), the flow of a molten steel supplied through the straight immersion nozzle 10 into the continuous casting mold 1 is controlled in a magnetic pole region of the traveling magnetic field generating device 5 disposed on the continuous casting mold 1. By virtue of this arrangement, it is possible to prevent the risk of nozzle clogging due to the adhesion of alumina, and hence, to prevent the risk of inclusions penetrating deep into the molten steel or the risk of an upward stream of the molten steel causing powders on the molten steel surface to be entrapped with the molten steel even when the molten steel is poured into the mold at a desired speed.

If the molten steel used in the present invention has an oxygen concentration of not more than 35 ppm, preferably, not less than 20 ppm, it is possible to correspondingly to reduce the generation and deposit of alumina. In this case, therefore, it is possible greatly to reduce the adhesion of alumina to the discharge hole of the nozzle without supply of an inert gas into the straight immersion nozzle is not effected.

Figure 3A:
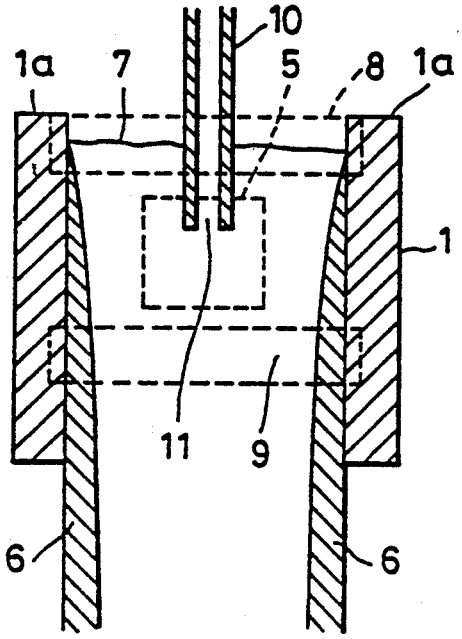
FIGS. 3(A) and 3(B) are sectional views respectively corresponding to FIGS. 1(A) and 1(B), showing another continuous casting apparatus which may be used to carry out a method according to the present invention.
Figure 3B:
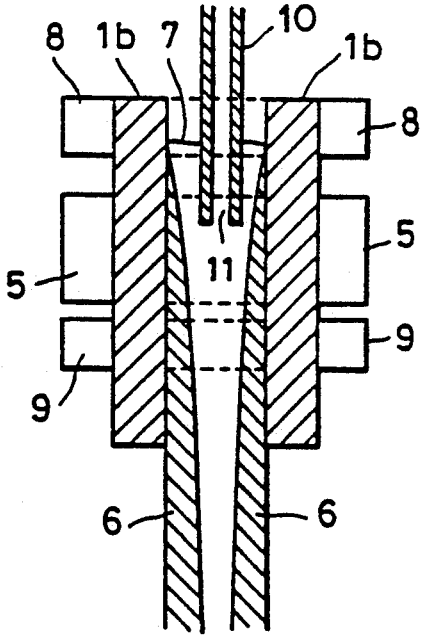

FIGS. 3(A) and 3(B) show another continuous casting apparatus which may be used to carry out a method according to the present invention. This apparatus is distinguished in that, in addition to the magnetic field device 5 it further includes upper and lower static magnetic field generating devices 8 and 9, each of which is disposed on an area of the outer surface of the wide face walls 1*b* of the continuous casting mold 1. The upper static magnetic field generating device 8 generates a static magnetic field perpendicular to the wide face mold walls 1*b*, which field is applied to the flow of the molten steel discharged from the straight immersion nozzle 10 in a first full-width region above the traveling magnetic field generating device 5 and in the vicinity of the molten steel surface. The lower static magnetic field generating device 9 generates a static magnetic field perpendicular to the wide face mold walls 1*b*, which field is applied to the flow of the molten steel discharged from the straight immersion nozzle 10 in a second full-width region below the traveling magnetic field generating device 5.

When continuous casting is conducted in which, as shown in FIGS. 1(A) and 1(B), the flow of the molten steel supplied through the straight immersion nozzle 10 into the continuous casting mold 1 is controlled in a magnetic pole region of the traveling magnetic field generating device 5 disposed on the continuous casting mold 1, is performed by simultaneously causing the molten steel surface to be stabilized by the use of the upper static magnetic field generating device 8, it is possible to prevent the risk of nozzle clogging due to the adhesion of alumina, and hence, to prevent the risk of inclusions penetrating deep into the molten steel or the risk of an upwardly directed stream of the molten steel causing powders on the molten steel surface to be entrapped even when the molten steel is poured into the mold at a desired speed.

The continuous casting shown in FIGS. 1(A) and 1(B) may be performed in such a manner that, while the flow of the molten steel is controlled in the magnetic pole region of the traveling magnetic field generating device 5, a downward stream of the molten steel is made uniform by the influence of the lower static magnetic field generating device 9. This makes it possible to obtain a highly pure steel slab which does not include mold powder or alumina powder.

Further, the continuous casting where, as shown in FIGS. 1(A) and 1(B), the flow of the molten steel is controlled in the magnetic pole region of the traveling magnetic field generating device 5, may be performed in such a manner that, while the aforementioned control takes place, the molten steel surface is stabilized by the use of the upper static magnetic field generating device 8 and a downward stream of the molten steel is made uniform by the use of the lower static magnetic field generating device 9. In this way it is possible to prevent the risk of nozzle clogging due to the adhesion of alumina, and hence, to prevent the risk of inclusions penetrating deep into the molten steel or the risk of an upwardly directed stream of the molten steel causing powders on the molten steel surface to be entrapped even when the molten steel is poured into the mold at the desired speed.

The traveling magnetic field used in the present invention should preferably have a strength ranging from 800 to 8000 gauss and a traveling speed of 0.2 to 15 m/s.

The values of these characteristics of the traveling magnetic field vary depending upon the diameter of the nozzle hole, the throughput and the continuous casting conditions adopted in accordance with the type of sheet steel or the like to be manufactured. If the strength of the traveling magnetic field is less than 800 gauss, or if the traveling speed is less than 0.2 m/s., it is impossible to adequately decelerate the flow of discharged molten steel. Conversely, if the magnetic field has values of these characteristics exceeding 8000 gauss and exceeding 15 m/s., too great an upwardly directed stream may develop, promoting the entrapping of powders at the molten steel surface.

Regarding the strength of the static magnetic fields, the static magnetic field in the first region above the traveling magnetic field generating device should preferably have a magnetic flux density from 1000 to 5000 gauss.

If this magnetic flux density is less than 1000 gauss, it is not possible adequately to lower the flow speed of the molten steel in the vicinity of the molten steel surface. Conversely, if that magnetic flux density exceeds 5000 gauss, the flow speed at the molten steel surface is reduced too much to provide sufficient washing of the surface portion of the slab cast. This may result in various inclusions and bubbles tending to adhere to the surface portion.

The static magnetic field in a second region below the traveling magnetic field should preferably have a magnetic flux density from 1000 to 7000 gauss. If this magnetic flux density is less than 1000 gauss, it is impossible adequately to reduce the velocity of downward stream. To do this, a magnetic flux density of not more than 7000 gauss (but not less than 1000 gauss) is sufficient.

The present invention will now be described by reference to specific Examples, which are not intended to limit or define the scope of the invention, which is defined in the appended claims.

EXAMPLE 1

A two-strand continuous casting machine was used to continuously cast three charges of a molten steel which had already passed through ladle smelting and which had a carbon (C) concentration of 360 to 450 ppm, an aluminum (Al) concentration of 450 to 620 ppm, and an oxygen (O) concentration of 27 to 30 ppm. The continuous casting was performed under the conditions shown below, and thereafter, the adhesion of alumina to the inner surface of the straight immersion nozzle was checked. In order to carry out the continuous casting according to the present invention, a traveling magnetic field generating device was disposed with its upper end positioned 100 mm above the lowermost end of the immersion nozzle, while its lower end was positioned 600 mm below the lowermost end of the immersion nozzle.

A two-hole immersion nozzle, as has been used in the conventional practice, was used to make one of the two strands (strand A; comparison example), while a straight immersion nozzle was used to make the other strand (strand B) according to the present invention. A traveling magnetic field was generated by only in making the strand B. Regarding the strand A, continuous casting was performed in two different ways, that is, with the use of Ar gas for preventing nozzle clogging with the gas supplied into the two-hole immersion nozzle at a rate of 10 liters/min, and without such Ar gas supply.

| [Casting Conditions] |
|---|
| Size of continuous casting mold: |
| width of narrow face walls: 230 mm |
| width of wide face walls: 1600 mm |
| Casting speed: 1.7 m/min. |
| Super-heat temperature of steel in the tundish: approx. 30° C. |
| Size of traveling magnetic field generating device: length: 700 mm; width: 500 mm |

-continued

| [Casting Conditions] |
|---|
| Speed of traveling magnetic field: 1.0 m/sec. |
| Maximum magnetic flux density of traveling magnetic field: approx. 3000 gauss |

As a result, in the case of the conventional continuous casting employing the two-hole immersion nozzle into which the Ar gas was supplied, a layer of adhering alumina, having a maximum thickness of 10 mm, was observed in the vicinity of the ejection holes of the nozzle. In the case of the continuous casting according to the present invention, although no Ar gas was supplied into the nozzle, a layer of adhering alumina had the maximum thickness of approximately 2 mm. Thus, it was confirmed that the present invention involves nozzle clogging only to a small extent.

When no Ar gas was supplied into the two-hole nozzle in the strand A, it became impossible to achieve a predetermined pouring speed during the stage of casting the second charge due to nozzle clogging. As a result, the casting speed dropped from 1.7 m/min. to 1.1 m/min. It was impossible to cast the third charge.

The slabs thus cast in the two strands were subjected to hot rolling and then cold rolling to produce cold rolled sheet steel having a thickness of 0.3 mm. The sheet steel products were checked with respect to the ratio of defects (specifically, the ratio of both internal defects and surface defects). The results of the check are shown in FIG. 4 (A).

With the method according to the present invention, the ratio of occurrence of defects of products dropped to 40%, a level considerably lower than the level achievable with the conventional method with the supply of Ar gas. Thus it was confirmed that the present invention has remarkable effectiveness in improving the quality of slab cast.

It is considered that this is because the application of a traveling magnetic field in a continuous casting mold prevents the flow of discharged molten steel from penetrating deep into the crater, and because Ar gas, which can be the chief cause of the generation of blisters, is not supplied.

EXAMPLE 2

A two-strand continuous casting machine was used to continuously cast 30 charges of molten steel which had a C concentration of 400 to 500 ppm, an Al concentration of 0.030 to 0.040%, and an O concentration of 20 to 25 ppm. The continuous casting was performed under the conditions shown below. In this Example the two strands A and B of the machine respectively featured a conventional two-hole immersion nozzle (comparison example) and a straight immersion nozzle. Regarding the strand B, a traveling magnetic field (specified in the list (a) below) and a static magnetic field generating device (specified in the list (b) below) disposed at an upper position of the mold above the traveling magnetic field, were employed according to the present invention.

| [Casting Conditions] |
|---|
| Size of continuous casting mold: |
| width of narrow face walls: 220 mm |
| width of wide face walls: 1300 mm |

-continued

[Casting Conditions]

| | |
|---|---|
| Casting speed: | 2.0 m/min. |
| Super-heat temperature of steel in the tundish: | 18 to 25° C. |
| Features of Strand A: | conventional 2-hole immersion nozzle<br>Ar gas supply at 12 litters/min.<br>(nozzle clogging prevention) |
| Features of Strand B: | straight immersion nozzle<br>no Ar gas supply<br>devices (a) and (b) used |
| (a) Traveling magnetic field Generating Device | |
| Position: upper end: | 50 mm above the lowermost end of the immersion nozzle discharge hole |
| lower end: | 400 mm below the same end |
| Size: length: 450 mm, width: 450 mm | |
| Traveling Speed of Magnetic Field: | 1.2 m/sec. |
| Maximum magnetic flux density of traveling magnetic field: | approx. 2500 gauss |
| (b) Static magnetic Field Generating Device | |
| Position: above the traveling magnetic field | |
| upper end: | 50 mm above the molten metal surface within the mold |
| lower end: | 100 mm below the same surface |
| Size: length: 150 mm, width: 1500 mm (width = slab width + 100 mm on each side) | |
| Maximum magnetic flux density: | approx. 3000 gauss |

Figure 4A:
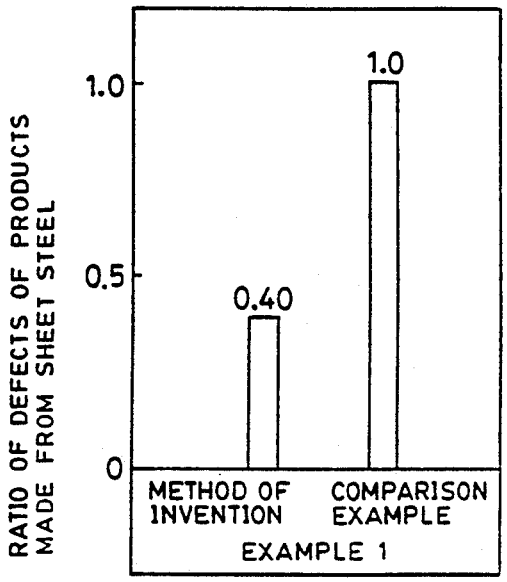
FIGS. 4 (A) through 4(D) are charts showing the results of comparison conducted in Examples 1 to 4 with respect to the ratio (in exponent) of the occurrence of defects of products made from steel sheet.
Figure 4B:
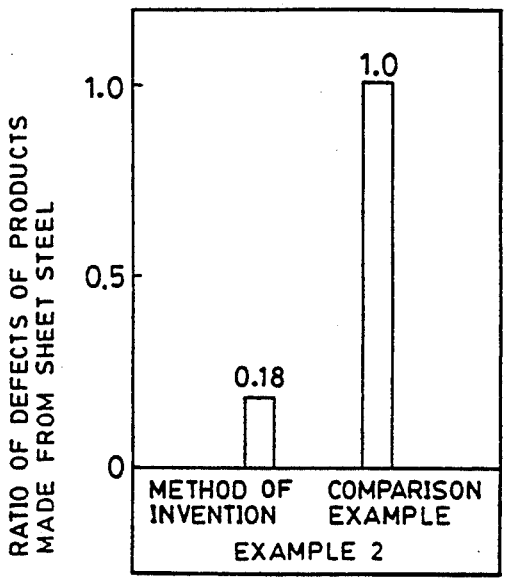

Cold rolled sheets having a thickness of 1.0 mm were produced from the thus cast slabs. FIG. 4(B) shows the results of checking the products made from sheet steel with respect to the ratio of internal and surface defects.

With the method according to the present invention, the ratio of occurrence of defects of products dropped to 18%. Thus, it has been confirmed that the present invention has remarkable effectiveness in improving the quality of slab cast.

The reason Example 2 proved more effective than Example 1 is that the former had, in addition to the arrangement of Example 1, an arrangement for applying a static magnetic field to an upper region in the mold so as to lower the speed of the flow of the molten steel in the vicinity of the molten steel surface, thereby reducing the amount of powders entrapped.

EXAMPLE 3

A two-strand continuous casting machine was used to continuously cast 22 charges of molten steel which had a C concentration of 450 to 560 ppm, an Al concentration of 0.035 to 0.044%, and an O concentration of 18 to 26 ppm. The continuous casting was performed under the conditions shown below, and the two strands A and B of the machine respectively featured a conventional two-hole immersion nozzle (comparison example) and a straight immersion nozzle in the following manner. Regarding the strand B, a traveling magnetic field (specified in the list (a) below) and a static magnetic field generating device (specified in the list (b) below) disposed at a lower position of the mold below the traveling magnetic field, were employed according to the present invention.

[Casting Conditions]

| | |
|---|---|
| Size of continuous casting mold: | |
| | width of narrow face walls: 220 mm<br>width of wide face walls: 1100 mm |

-continued

[Casting Conditions]

| | |
|---|---|
| Casting speed: | 1.8 m/min. |
| Super-heat temperature of steel in the tundish: | 20 to 25° C. |
| Features of Strand A: | conventional 2-hole immersion nozzle<br>Ar gas supply at 15 litters/min.<br>(nozzle clogging prevention) |
| Features of Strand B: | straight immersion nozzle<br>no Ar gas supply<br>devices (a) and (b) used |

(a) Traveling Magnetic Field Generating Device

This device had exactly the same position, size, traveling speed of magnetic field, and maximum magnetic flux density of traveling magnetic field as the corresponding device of Example 2.

(b) Static Magnetic Field Generating Device

| | |
|---|---|
| Position: below the traveling magnetic field | |
| upper end: | 500 mm below the lowermost end of the immersion nozzle discharge hole |
| lower end: | 650 mm below the same end |
| Size: length: 150 mm, width: 1300 mm (width = slab width + 100 mm on each side) | |
| Maximum magnetic flux density: | approx. 2500 gauss |

Figure 4C:
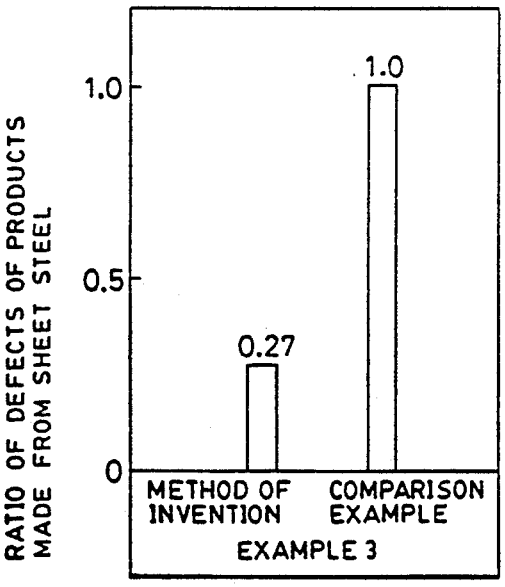

Cold rolled sheets having a thickness of 0.8 mm were produced from the thus cast slabs. FIG. 4(C) shows the results of checking the products made from sheet steel with respect to the ratio of internal and surface defects.

With the method according to the present invention, the ratio of the occurrence of defects of products dropped to 27%. Thus, it has been confirmed that the present invention has remarkable effectiveness in improving the quality of slab cast.

The reason Example 3 proved more effective than Example 1 is that the former had, in addition to the arrangement of Example 1, an arrangement for applying a static magnetic field to a lower region in the mold so as to make uniform a downward stream of the molten steel, thereby succeeding in obtaining a highly pure steel slab containing a very small amount of inclusions.

EXAMPLE 4

A two-strand continuous casting machine was used to continuously cast 15 charges of a molten steel which had a C concentration of 20 to 35 ppm, an Al concentration of 0.040 to 0.052%, and an O concentration of 22 to 29 ppm. The continuous casting was performed under the conditions shown below, and the two strands A and B of the machine respectively featured a conventional two-hole immersion nozzle (comparison example) and a straight immersion nozzle. Regarding the strand B, a traveling magnetic field (specified in the list (a) below), a static magnetic field generating device (specified in the list (b1) below) disposed at an upper position of the mold above the traveling magnetic field, and another static magnetic field generating device (specified in the list (b2) below) disposed at a lower position of the mold below the traveling magnetic field, were employed according to the present invention.

| [Casting Conditions] | |
|---|---|
| Size of continuous casting mold | |
| | width of narrow face walls: 260 mm |
| | width of wide face walls: 1300 mm |
| Casting speed: | 2.5 m/min. |
| Super-heat temperature of steel in the tundish: | |
| | 26 to 35° C. |
| Features of strand A: | conventional 2-hole immersion nozzle |
| | Ar gas supply at 15 litters/min. |
| | (nozzle clogging prevention) |
| Features of strand B: | straight immersion nozzle |
| | no Ar gas supply |
| | devices (a), (b1) and (b2) used |

(a) Traveling Magnetic Field Generating Device

This device had exactly the same position, size, traveling speed of magnetic field, and maximum magnetic flux density of traveling magnetic field as the corresponding device of Example 2.

(b-1) Upper Static Magnetic Field Generating Device

| | |
|---|---|
| Position: above the traveling magnetic field | |
| upper end: | 50 mm above the molten steel surface in the mold |
| lower end: | 100 mm below the same surface |
| Size: length: 150 mm, width: 1500 mm | |
| (width = slab width + 100 mm on each end) | |
| Maximum magnetic flux density: | |
| | approx. 2800 gauss |
| (b-2) Lower Static Magnetic Field Generating Device | |
| Position: below the traveling magnetic field | |
| upper end: | 500 mm below the lowermost end of the immersion nozzle discharge hole |
| lower end: | 650 mm below the same end |
| Size: length: 150 mm, width: 1500 mm | |
| (width = slab width + 100 mm on each end) | |
| Maximum magnetic flux density: | |
| | approx. 3500 gauss |

Figure 4D:
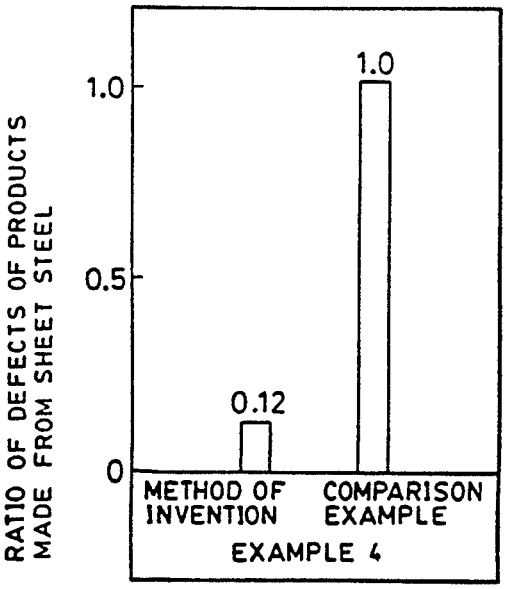
Figure 5:
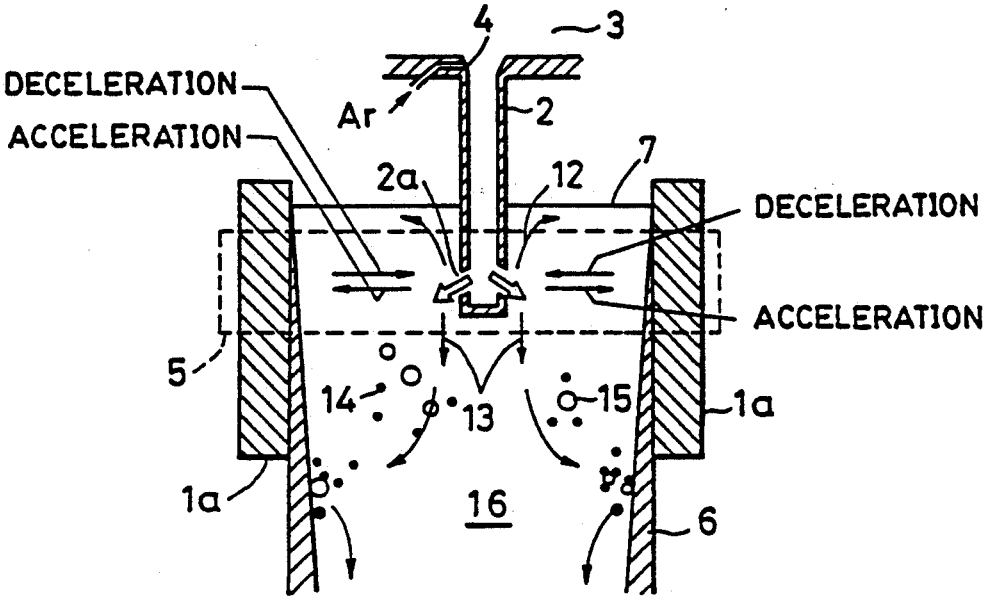
FIG. 5 is a front sectional view showing the relevant parts of a continuous casting apparatus used to carry out a conventional method.
Figure 6:
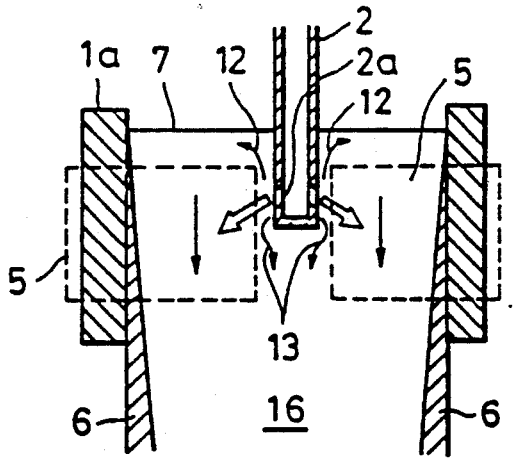
FIG. 6 is a front sectional view showing the relevant parts of another continuous casting apparatus used to carry out another conventional method.

Cold rolled sheets having a thickness of 0.9 mm were produced from the thus slab cast. FIG. 4(D) shows the results of checking the products made from sheet steel with respect to the ratio of internal and surface defects.

With the method according to the present invention, the ratio of occurrence of defects of products dropped to 12%. Thus, it has been confirmed that the present invention has remarkable effectiveness in improving the quality of slab cast.

The reason Example 4 proved more effective than Example 1 is that the former had, in addition to the arrangement of Example 1, an arrangement for applying a static magnetic field to an upper region in the mold, which succeeded in reducing the amount of powders entrapped, and an arrangement for applying a static magnetic field to a lower region in the mold, which succeeded in obtaining a highly pure steel slab containing a very small amount of inclusions.

As has been described above, according to the present invention, it is possible to perform continuous casting stably, and to improve the product quality as well as producibility.

Particularly when static magnetic field(s) and a traveling magnetic field are used together, it is possible to obtain a continuously cast slab of better quality than previously obtainable. It has been confirmed that, when the molten steel has a relatively low oxygen concentration, such continuous casting can be performed without inert gas supply for preventing nozzle clogging. This in turn enables defects caused by the inert gas to be eliminated.

What is claimed is:

1. A method of continuously casting a steel slab comprising:

supplying a molten steel having an oxygen concentration of not more than 35 ppm from a tundish containing said molten steel into a continuous casting mold through a substantially straight immersion nozzle having an open end at the forward end thereof to cause said molten steel to flow downwardly, said mold having a pair of narrow face mold walls and a pair of wide face mold walls;

disposing a traveling magnetic field generating device on a generally central area of the outer surface of said wide face mold walls; and while said open forward end of said nozzle is positioned in the magnetic field region of said traveling magnetic field generating device, applying a traveling magnetic field which is substantially perpendicular to said wide face mold walls, moving said magnetic field substantially upwardly in a direction opposed to said downward flow of said molten steel discharged from said nozzle, thereby controlling said flow.

2. A method according to claim 1, further comprising the steps of disposing a static magnetic field generating device on an area of said outer surface of said wide face mold walls which extends over the full width of said wide face mold walls and which is in the vicinity of the molten steel surface in said mold; and applying a static magnetic field substantially perpendicular to said wide face mold walls to a full-width region above said traveling magnetic field and in the vicinity of said molten steel surface, thereby stabilizing said molten steel surface.

3. A method according to claim 1, further comprising the steps of disposing a static magnetic field generating device on an area of said outer surface of said wide face mold walls which extends over the full width of said wide face mold walls and which is at a position below said traveling magnetic field generating device; and applying a static magnetic field substantially perpendicular to said wide face mold walls to a full-width region below said traveling magnetic field, thereby providing a substantially uniform downward stream of said molten steel.

4. A method according to claim 1, further comprising the steps of disposing static magnetic field generating devices on areas of said outer surface of said wide face mold walls which extend over the full width of said wide face mold walls and which are at a position above said traveling magnetic field generating device corresponding to the molten steel surface in said mold and a position below said traveling magnetic field generating device; and applying a static magnetic field perpendicular to said wide face mold walls to a full-width region in the vicinity of said traveling magnetic field, thereby stabilizing said molten steel surface, while applying a static magnetic field perpendicular to said wide face mold walls to a full-width region below said traveling magnetic field, thereby making uniform a downward stream of said molten steel.

5. A method according to any of claims 1, 2, 3 and 4, wherein said traveling magnetic field has a magnetic flux density of 800 to 8000 gauss, and a magnetic field upward traveling speed of 0.2 to 15 m/sec.

6. A method according to any of claims 2, 3 and 4, wherein said static magnetic field above said traveling magnetic field generating device has a magnetic flux density of 1000 to 5000 gauss, and said static magnetic field below said traveling magnetic field has a magnetic flux density of 1000 to 7000 gauss.

* * * * *